United States Patent [19]

Dungan

[11] 4,046,365

[45] Sept. 6, 1977

[54] STIRRUP GUARD FOR MEDICAL EXAMINATIONS

[76] Inventor: Shirley A. Dungan, 3370 W. Aksarben, Littleton, Colo. 80123

[21] Appl. No.: 700,405

[22] Filed: June 28, 1976

[51] Int. Cl.[2] ..... A61G 13/00

[52] U.S. Cl. ..... 269/328

[58] Field of Search ..... 269/328; 5/327 R, 327 B, 5/337, 338, 339; 128/94, 166, 133, 134, 1 R, 1 B; 312/1

[56] References Cited

U.S. PATENT DOCUMENTS

| | | | |
|---|---|---|---|
| 830,661 | 9/1906 | Gresham | 5/327 R |
| 2,085,296 | 6/1937 | Carey | 5/327 R |
| 2,695,605 | 11/1954 | Gibbon | 128/1 B |
| 3,313,289 | 4/1967 | Kapral | 128/1 R |
| 3,452,978 | 7/1969 | Creelman | 269/328 |
| 3,643,938 | 2/1972 | Levasseur | 269/328 |

*Primary Examiner*—Al Lawrence Smith
*Assistant Examiner*—Robert C. Watson
*Attorney, Agent, or Firm*—John E. Reilly

[57] ABSTRACT

In medical examinations, a stirrup guard has been devised for foot supports on an examining table which will serve as a cushioned, protective covering over a foot stirrup and the like in order to provide a firm, but flexible means of support and bracing for the foot, the stirrup guard being characterized by having a relatively thin, normally flat body portion composed of a resilient material provided with a central opening therein together with releasable fasteners which will effect attachment of the body portion in overlying relation to a stirrup guard in such a way that the foot can be securely positioned and braced in the stirrup without experiencing undue discomfort.

9 Claims, 5 Drawing Figures

STIRRUP GUARD FOR MEDICAL EXAMINATIONS

SPECIFICATION BACKGROUND AND FIELD OF INVENTION

This invention relates to novel and improved protective coverings or pads for brace members; and more particularly relates to a novel and improved form of guard which is particularly adaptable for use as a protective covering over a foot stirrup employed in medical examinations.

Certain medical examinations require that the patient be in a prone position with the feet braced to some extent in order to place the legs in a raised or somewhat bent position. For instance, in gynecological or rectal examinations, customarily the examining table is equipped with foot stirrups at one end of the table to receive and brace the feet. Various different types of stirrups have been devised but are typically in the form of an open frame having a crossbar extending between a pair of side bars which converge into a common attachment point. The stirrup is dimensioned such that the patient may place the instep of the foot against the crossbar with the heel disposed in the opening beneath the crossbar and between the side bars. Generally, the stirrup is pivotally connected at the attachment point between the side bars on a vertically adjustable rod so that both the attitude and height of the stirrups can be regulated according to the height of the patient and nature of the examination.

Although it is highly desirable that the stirrup be so constructed as to provide a rigid brace to assure that the patient will not move or shift the legs or feet, stirrups presently in use tend to be quite uncomfortable particularly when the patient is required to remain in one position for any length of time or if undue pressure is applied against the stirrup. On the other hand, any cushioning or protective covering for the stirrup must be so constructed as to permit the foot to be firmly braced. However, in that respect, unduly localized cushioning along the crossbar or side bars has not been found to satisfactorily cushion the foot particularly along the instep portion.

Various cushioning members have been devised for different purposes and for instance U.S. Pat. No. 3,452,978 to Creelman discloses a padded stirrup device in which a sleeve-type member forms a flexible saddle or seat across the breadth of the stirrup. In addition, U.S. Pat. No. 3,848,281 to Mathews and U.S. Pat. No. 1,886,637 to Buckley illustrate different forms of cushioned pads of generally circular configuration which are employed to prevent bed sores or to rest an infant's head. Still other variations in cushion members or pads are disclosed in U.S. Pat. No. 3,145,397 to Liftman, U.S. Pat. No. 3,828,377 to Fary, Sr. and U.S. Pat. No. 3,866,251 to Pounds. The above and other cushion devices do not afford the desired configuration and cushioning as well as other requisites for specialized use as a stirrup guard in medical examinations, particularly to ease of conformability to different foot stirrup configurations and types.

Accordingly, it is an object of the present invention to provide for a novel and improved stirrup guard for use in medical examinations.

It is another object of the present invention to provide for a novel and improved protective covering which is specifically conformable for use in association with foot stirrups on an examining table to serve as a firm, flexible means of support for the foot.

It is a further object of the present invention to provide for a protective covering for an open type of brace member which is so constructed and arranged as to permit positive but releasable fastening to different specific configurations of brace members.

It is an additional object of the present invention to provide for a cushioned, protective pad which is conformable for use and releasable connection to a foot stirrup used for medical examinations in which the pad will conform to different configurations of stirrups and can be securely but releasably attached in such a way as to follow the contour of the stirrup; and further is sanitary, simplified in construction and safe to use in such a manner as to greatly minimize discomfort to the foot.

SUMMARY OF THE INVENTION

In accordance with the present invention there has been devised a protective covering which in the preferred embodiment of the present invention takes the form of a relatively thin, normally flat body portion of generally circular or oval-shaped configuration, the body portion being composed of a resilient or flexible material which is sized to overlie the crossbar and side bars of a foot stirrup employed in medical examinations. The protective pad is further characterized in being provided with a central opening to increase the flexibility and conformability of the pad to different sizes and types of stirrups while serving as a receptacle for the heel portion of the foot when it is placed against the crossbar of the stirrup. Moreover, the pad is characterized by releasable fasteners in the form of tie strings which pass through the thickness of the body at spaced intervals so as to permit positive but releasable connection of the pad in overlying relation to a stirrup and in such a way as to greatly minimize the possibility of shifting or misalignment of the pad with respect to the stirrup. The pad is further characterized by its simplicity in construction in that it can be readily formed out of a sheet of foam plastic or resin material and is most desirably covered with an outer non-porous film or coating. The tie strings are attachable in such a way as to be readily adjusted as desired in accordance with the size or configuration of the stirrup and to facilitate attachment of the pad so as to most closely conform to the configuration of the stirrup.

BRIEF DESCRIPTION OF THE DRAWINGS

Other objects, advantages and capabilities of the present invention will become more apparent as the description proceeds taken in conjunction with the accompanying drawings, in which.

DETAILED DESCRIPTION OF THE PREFERRED EMBODIMENT

Figure 1:
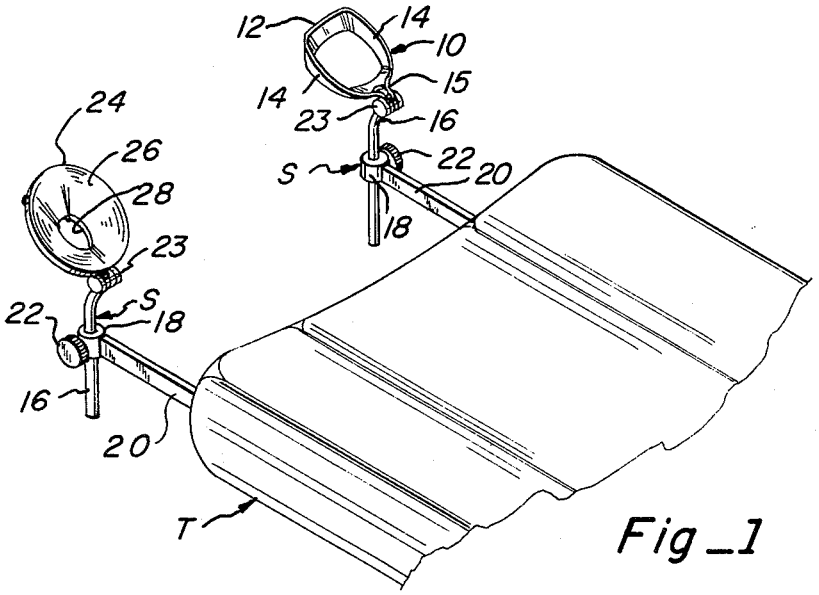
FIG. 1 is a somewhat fragmentary perspective view illustrating one end of a medical examining table and showing disposition of a preferred form of stirrup guard in place on a pair of adjustable stirrups at the end of the table, in accordance with the present invention.
Figure 2:
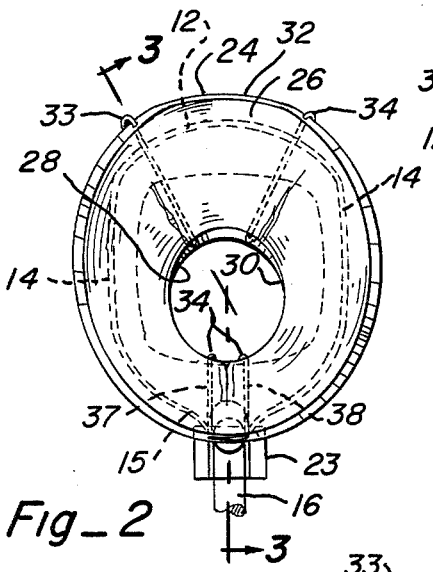
FIG. 2 is an elevational view of a preferred form of stirrup guard.
Figure 3:
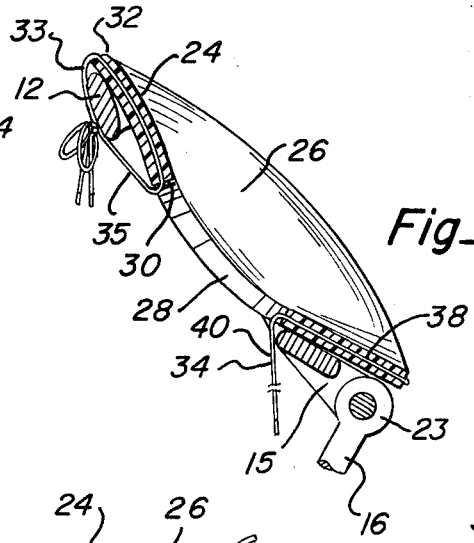
FIG. 3 is a cross-sectional view taken about lines 3—3 of FIG. 2.
Figure 4:
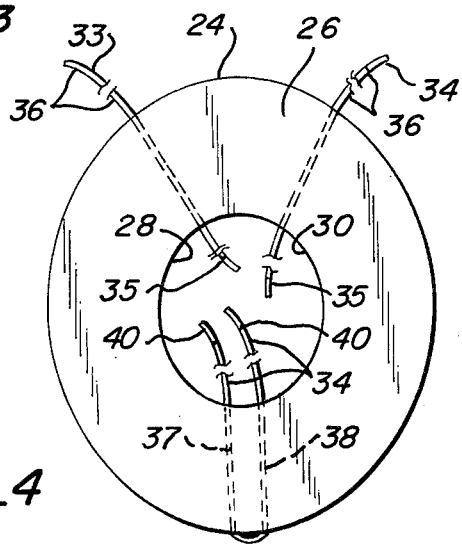
FIG. 4 is a rear view in elevational of the preferred form of stirrup guard of the present invention.
Figure 5:
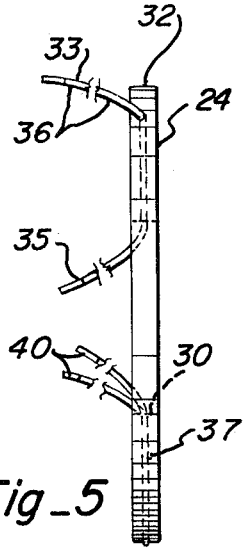
FIG. 5 is a side view of the preferred form of stirrup guard.

Referring in detail to the drawings, there is shown by way of illustrative example in FIG. 1 a conventional type of medical examination table T, at the foot end of which are disposed a pair of adjustable stirrups S. Each stirrup or foot support S is conventionally comprised of a stirrup member 10 in the form of an open brace or frame having a crossbar 12 and side bars 14 connected to opposite ends of the crossbar 12 and converging into a common yoke 15 which is adapted for pivotal connection to the upper end of a vertically adjustable rod 16. Each rod is slidable through a sleeve 18 at the free end of a main support bar 20 which extends horizontally from attachment to the end or underside of the table, and a manually rotatable locking screw 22 is inserted in the sleeve 18 to permit releasable locking or setting of the rod 16 to position the stirrup at the desired height above the table. Similarly, a pivot member 23 at the upper end of the rod is threadedly adjustable to releasably lock the stirrup at the desired attitude or angle with respect to the rod. The foregoing description of a conventional form of stirrup assembly on an examining table is provided as a setting for the present invention and is merely representative of various types of stirrups with which the stirrup guard of the present invention may be utilized. In this respect the type of stirrup shown is characterized in that the crossbar 12 is slightly offset beneath the side bars 14 so that the patient may place the foot in a stirrup with the instep resting against the crossbar 12 and the heel placed in the opening formed between the crossbar 12, side bars 14 and the yoke 15. Generally the stirrup as described is formed of a metal casting or forging to provide a rigid brace or support for the foot; and unless the patient wears shoes can be extremely uncomfortable to the patient in retaining the foot in the stirrup for any length of time at all.

In accordance with the present invention, a preferred form of stirrup guard 24 is adaptable for releasable attachment in overlying relation to a stirrup S. The preferred form of stirrup guard is designed to closely conform to various configurations of stirrups while permitting releasable but secure attachment in overlying relation to the stirrup so as to insulate the foot from the metal side bars and crossbar, but permit the foot to be securely retained in place within the stirrup. To this end, a preferred form of stirrup guard 24, as shown in more detail in FIGS. 2 to 5, is broadly comprised of a relatively thin, normally flat body portion 26 which is of generally oval-shaped configuration and provided with a central opening 28 therein. The opening 28 preferably is of limited size with respect to the remaining width of the body portion so that the body is of relatively wide annular configuration having an inner edge 30 in surrounding relation to the opening 28 and an outer peripheral edge 32. In this way the central opening will afford some additional flexibility or "give" to the body so that when seated in overlying relation to the stirrup and foot pressure is applied can assume a generally concave or cup-shaped configuration as illustrated in FIG. 1. Moreover, the body is of sufficient width so as to fully cover and effectively surround the rigid frame of the stirrup when fastened in place.

In the preferred form, releasable fastening means is defined by tie strings 33, 34 and 35 arranged at spaced intervals around the body to permit positive but releasable connection of the stirrup guard in place over the stirrup. The upper tie strings 33 and 34 are preferably disposed in relatively closely spaced relation to one another, each tie string 33 and 34 extending generally in a radial direction through bores or grooves extending radially through the width of the body the strings each having opposite free ends 35 and 36 extending away from the inner and outer edges 30 and 32, respectively, of the body portion. It will be noted that the free ends 35 and 36 are of a length such that they can be tied or joined to one another around the crossbar portion 12 of the stirrup.

The lower tie string 34 similarly extends generally in a radial direction through adjoining radial grooves or bores formed to extend the width of the body portion so that the string 34 may be passed through one of the radial grooves 37 and returned through another radial groove 38 in closely spaced relation to the groove 37, and the free ends 40 of the string 34 will extend away from the inner edge of the body portion. The free ends 40 also are of a length sufficient to permit their being passed downwardly around the upper portion of the adjustable rod 16 and tied together so as to securely position the lower portion of the body in overlying relation to the yoke 15 and upper end of the rod, again as illustrated in FIG. 1.

It will be evident that the lower string may be reversed so that the free ends 40 pass outwardly from the outer peripheral edge 32 of the body portion, again depending upon the specific configuration and contour of the stirrup. The fastening strings as described however do afford additional versatility and conformability for the stirrup guard in adapting it to two different types of stirrups and in such a way that the inner edge of the body may be depressed or drawn inwardly through the central opening in the stirrup to form a firm seat for the heel portion while cushioning the foot and distributing the pressure more evenly across the ball and instep portion of the foot. It will be apparent that other types of fastening elements or means may be employed in place of the tie strings as described to facilitate attachment of the protective guard to each stirrup. However, a noteworthy advantage of the fastening strings as employed in the preferred form so as to extend away from the inner and outer edges of the body portion is to cause the body portion to more closely conform to the contour of the stirrups when tied in place so as to assume the concave or cup-shaped configuration as shown in FIG. 1. This will better encourage the patient to properly center the foot within the stirrup and afford the necessary degree of cushioning without danger of the foot slipping or shifting once in place. In this relation, it is also preferred that the central opening be limited with respect to the width of the body portion and be just large enough to afford some additional flexibility in the center of the pad so as to permit it to be drawn downwardly or inwardly to some extent when foot pressure is applied.

Preferably, the body portion is of one-piece construction and is composed of a cellular or foam plastic material which is covered with an outer protective, relatively non-porous film or coating such as any of the commerically available polyvinylchloride films or coatings. In this manner, a plurality of stirrup guards may be formed by cutting out of a single sheet into the desired circular or oval-shaped configuration and the central opening similarly may be cut to the desired size out of each stirrup guard. The radial bores which receive the tie strings may then be formed to extend through the thickness of the body portion. In the alternative, the stirrups may be formed individually in a molding or casting operation so that the radial bores are formed at the desired locations in the casting process so as to eliminate a separate forming operation.

It is therefore to be understood that various modifications and changes may be made in the specific construction and arrangement of the stirrup guard as described, as well as its method of manufacture, without departing from the spirit and scope of the present invention as defined by the appended claims.

What is claimed is:

1. In a foot support adaptable for use in medical examinations and the like wherein an examining table is provided with stirrups at one end of the table to support the patient's feet, each stirrup being characterized by having an outer surrounding, substantially rigid frame and inner hollow portion, the combination therewith comprising:

a protective pad defined by a normally flat body composed of a resilient material provided with a central opening therein, said body dimensioned to overlie and extend beyond the outer frame member, and releasable fastener means at spaced intervals on said body adapted to releasably attach said pad in overlying relation to a stirrup with the central opening aligned with the inner hollow portion of said stirrup.

2. In a foot support according to claim 1, said body being of generally oval-shaped configuration having inner and outer peripheral edges, the inner edge forming the surrounding edge of the central opening.

3. In a foot support according to claim 2, the width of said body between inner and outer edges being dimensioned to be at least as great as the diameter of the central opening.

4. In a foot support according to claim 1, said releasable fastener means defined by generally string-like connectors extending at spaced intervals from the outer peripheral edge of said body.

5. In a foot support according to claim 2, said releasable fastener means being defined by generally string-like connectors extending from the inner and outer edges of said body.

6. In a foot support according to claim 2, said releasable fastener means defined by a plurality of tie strings, there being a pair of strings in closely spaced relation extending generally in a radial direction through the width of said body and each terminating in outer free ends extending from the inner and outer edges of said body.

7. In a foot support according to claim 6, said releasable fastener means including at least one string member extending in a generally radial direction through the width of said body and terminating in free end portions extending away from the inner edge of said body.

8. A stirrup guard adaptable for use as a protective covering for a stirrup employed in gynecological examinations and the like wherein a pair of stirrups are located in spaced relation to one another at one end of an examining table to support the patient's feet, said stirrup guard comprising:

a thin, normally flat body of one-piece construction composed of a resilient material provided with a central opening therein, said body adapted to overlie a stirrup, and string members extending at spaced intervals from inner and outer edges of said body portion for releasable connection to said stirrup, including a pair of strings in closely spaced relation to one another at the upper end of said body each including outer free ends extending respectively from the inner and outer edges of said body, and a lower string member extending generally in a radial direction through the thickness of said body and terminating in a pair of outer free ends extending away from the inner edge of said body portion, the outer free ends of said string members being of a length to permit secure but releasable independent connection to said stirrup.

9. A stirrup guard according to claim 8, the body portion being composed of a resilient plastic foam having an outer non-porous covering.

* * * * *